United States Patent [19]

Bauer

[11] Patent Number: 5,020,756

[45] Date of Patent: Jun. 4, 1991

[54] SHELF SUSPENSION MEMBER FOR DOUBLE-HUNG SASH WINDOWS

[76] Inventor: Peter Bauer, 13921 Esworthy Rd., Germantown, Md. 20874

[21] Appl. No.: 453,163

[22] Filed: Dec. 19, 1989

Related U.S. Application Data

[63] Continuation of Ser. No. 294,976, Jan. 3, 1989, abandoned, which is a continuation of Ser. No. 928,213, Nov. 7, 1986, abandoned.

[51] Int. Cl.[5] ..... A47G 29/00

[52] U.S. Cl. ..... 248/236; 248/250; 47/40

[58] Field of Search ..... 248/236, 238, 235, 208, 248/250, DIG. 9, 548, 247, 201, 304; 211/90, 88; 108/46, 108, 149, 144, 106, 107; 182/57, 53; 47/40, 68

[56] References Cited

U.S. PATENT DOCUMENTS

| | | | |
|---|---|---|---|
| 324,291 | 8/1885 | Bennett | 211/90 X |
| 557,875 | 4/1896 | Pittet | 248/236 |
| 727,423 | 3/1903 | Oppenheimer | 248/236 |
| 1,518,091 | 12/1924 | Mathis et al. | 182/57 X |
| 1,897,810 | 2/1933 | Mallory et al. | 182/57 |
| 2,059,011 | 10/1936 | Moewes | 248/236 X |
| 2,831,598 | 4/1958 | Slavsky et al. | 211/88 X |
| 4,653,712 | 3/1987 | Murray et al. | 248/236 |

FOREIGN PATENT DOCUMENTS

| | | | |
|---|---|---|---|
| 55556 | 9/1902 | Austria | 182/53 |

*Primary Examiner*—Karen J. Chotkowski

*Attorney, Agent, or Firm*—Griffin Branigan & Butler

[57] ABSTRACT

Shelf suspension member for shelf arrangements that install easily and quickly on sash windows without tools or fasteners by engaging into existing window structures and by being supported by or suspended from such structures in cantilevered manner, which is convenient in use, low in cost and attractive in appearance, which does not appreciably obstruct daylight, and which permits opening of at least a part of the window without removal of the arrangement.

13 Claims, 12 Drawing Sheets

SHELF SUSPENSION MEMBER FOR DOUBLE-HUNG SASH WINDOWS

This is a continuation of application Ser. No. 07/294,976 filed Jan. 3, 1987, which is a continuation of Ser. No. 06/928,213, filed Nov. 7, 1986, both now abandoned.

BACKGROUND

The present invention relates to shelf suspension members for shelf arrangements, in particular for easy and quick installation and mounting on, respectively removal from double-hung sash windows and associated window frame structures without a need for tools, special skills, and without need for invasive measures for fastening, as for instance given by conventionally required screw or anchor holes in wall, window, or window frame.

Shelf space, particularly near and inside of certain windows, is generally desired and needed in many households and other buildings. For instance, potted plants and miscellaneous utilitarian and decorative articles are often placed on or near the sill or kitchen windows (as well as other windows)—usually in places where there is little space anyway. Flowers, herbal plants, vases, ornaments, knick-knacks, books, etc. are kept in such locations, often because of high visibility, hardiness, and high daylight levels, as well as for reasons of convenience and accessibility. Shelf arrangements for locations directly in front of and on the inside of windows have not been available commercially. Although appropriate adaptations of known or commercially available shelf arrangements might perhaps be visualized by a person skilled in the art, the complexity and comparatively high cost of the relatively time-consuming adaptations and the need for permanent fastening to wall, window frame, or window by means of screws, anchors, clamps, etc., as well as the most likely resulting clumsy and unappealing appearance have precluded adoption of such shelf arrangements. Additionally, such arrangements do not permit easy access to the window, do not allow quick and easy installation and removal of the shelf arrangement, and may not permit convenient opening of at least part of the window without removal of the shelf arrangement.

Accordingly, it is an object of the present invention to provide an improved shelf suspension member for shelf arrangements which mount on (and may be removed from) a sash window structure.

Advantages of the suspension members of the invention are that they are mounted easily and quickly without any need for tools and fasteners, which require no special skill in installation or removal, which are convenient, low in cost and attractive in appearance, which do not significantly obstruct daylight entering through the window, which permit opening of at least part of the window without removal of the shelf arrangement or the articles carried by it, and which exhibit further advantages which will become apparent from the detailed description of the present invention.

SUMMARY

Briefly, a shelf arrangement incorporating the shelf suspension member of the present invention mounts in cantilevered manner onto the sash window and frame structure itself by means utilizing existing window components as both vertical load force and tilting force bearing surface in such a way that installation and removal of the shelf arrangement is easy and quick, needs neither tools nor special skills, and does not require any fastening means or provisions, as might for instance be given by screws, anchors, clamps, nails, hooks, etc., which are almost inevitably necessary for mounting of prior-art shelf arrangements. Consequently, holes in wall or window structures are entirely avoided.

In particular, a shelf arrangement incorporating the shelf suspension member of the present invention can also comprise at least one shelf board in connection with arrangements to facilitate mounting and secure holding on an appropriate window structure. Such arrangements comprise means for supporting the vertical load and weight of the shelf arrangement (together with the load placed on the shelf by the user) on suitable structural parts of the window or its frame and means for taking up and transferring the tilting forces experienced by the cantilevered shelf arrangement onto the window and its frame. Take-up of one part of the tilting force couple is provided by appropriate surfaces of the shelf arrangement which lean against suitable window or window frame surfaces, and take-up of the other part of the tilting force couple is provided by appropriate engagement means which engage or hook into the sash channels. Hooking-in or installing of the shelf arrangement on the window and its frame is simply a matter of the user lifting the arrangement in appropriate orientation onto the window, hooking the engagement means into the sash channels, and placing the shelf arrangement onto the appropriate window or window frame surfaces in the shelf's final location and orientation. Installation is thus achieved entirely without a need for any kind of fastening onto the window or its frame. Removal of the shelf arrangement is simply achieved by reversing the order of the described procedure.

BRIEF DESCRIPTION OF THE DRAWINGS

For a better understanding of the invention, reference should be made to the following detailed description given in connection with the accompanying drawings wherein the same reference numerals have been used to designate like parts or components in the various illustrations wherever it might facilitate understanding. The drawings are not necessarily intended to be to scale, but rather are presented so as to illustrate principles of the invention. Unless specifically indicated otherwise, the following descriptions use terms applying to location, direction, orientation, etc. from an approximate eye-level point of view originating indoors and facing a window. Thus for instance, the front of a component shall mean the portion of it facing toward the point of view (facing indoors) and the rear or back of a component shall face toward outdoors.

DESCRIPTION OF THE ILLUSTRATED EMBODIMENTS

The shelf arrangement incorporating the shelf suspension member of the present invention mounts on the sash window in cantilevered manner without a need for tools and fasteners simply by engaging into the sash channels and bearing on existing window structures.

Figure 1:
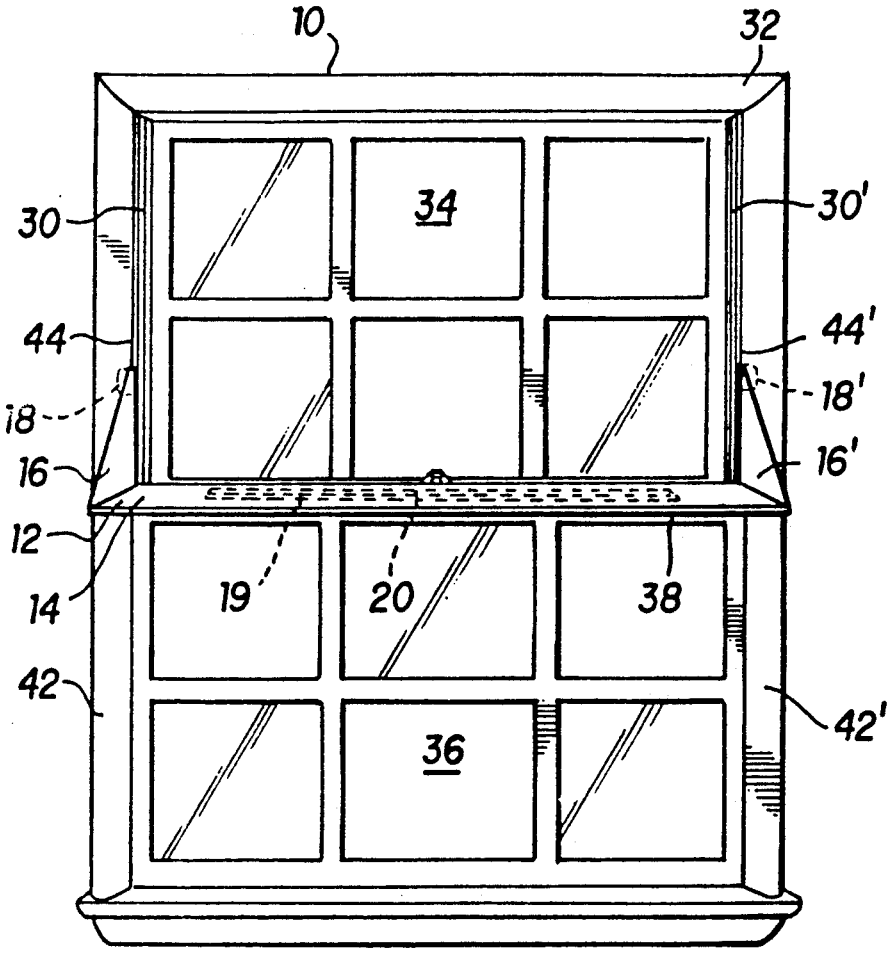
FIG. 1 is a schematic perspective front view of a sash window with a shelf arrangement incorporating the shelf suspension member of the present invention installed in a location approximately in the middle of the window.

FIG. 1 illustrates schematically a view of a sash window 10, as seen from the inside of a building, with a shelf arrangement 12 incorporating the shelf suspension member of the present invention installed near the middle of the window approximate the level of the lower top rail 38 when the lower sash 36 and in its closed position. The upper sash 34 is also shown in its closed position for clarity's sake, although it could be in any position. Among the multitude of components making up the conventional sash frame structure 32 of window 10 are the left side casing 42 and the right side casing 42'. At the inside vertical edges of these side casings are located the so-called inside stops 44 (on left) and 44' (on right). The inside stops are often formed by vertical molding strips and they shelter the sash channels (left sash channel 30 and right sash channel 30' respectively) which serve the lower sash 36 on the side facing indoors. These molding strips are not separately depicted in FIG. 1, but they are shown as part of the side casings, as this is generally the image obtained from this view.

Figure 2:
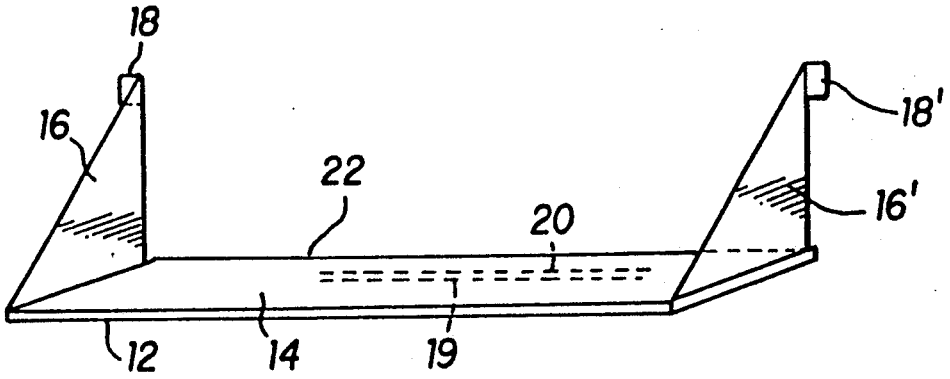
FIG. 2 is a schematic isometric view of a shelf arrangement incorporating the shelf suspension member of the present invention as also shown in FIG. 1.
Figure 3:
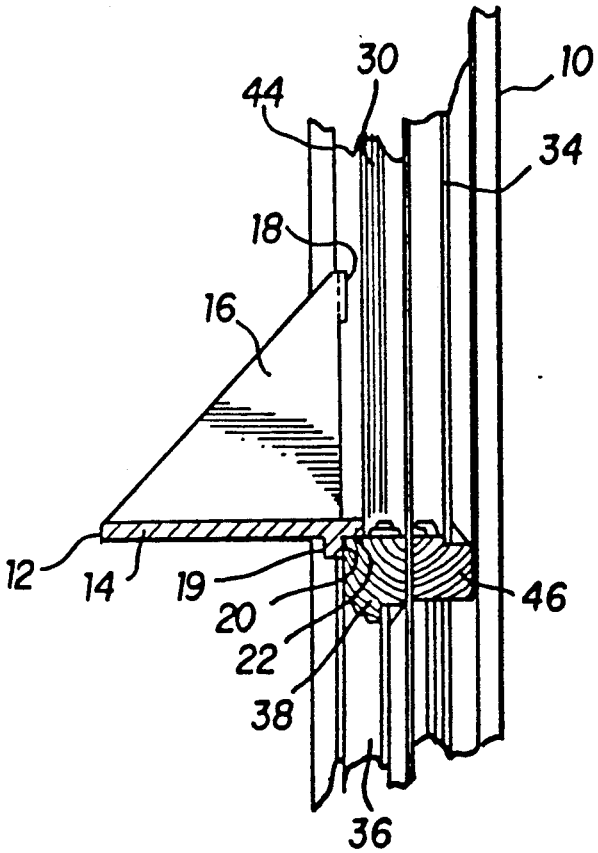
FIG. 3 is an enlarged schematic partial side sectional view of a typical sash window structure in the region of the middle of the window with a sectional view of the installed shelf arrangement incorporating the shelf suspension member of the present invention, as also illustrated in FIG. 1.

The shelf arrangement 12 in FIG. 1 is best described in conjunction with its schematic depiction in FIG. 2 and its schematic side sectional view included in FIG. 3, wherein the shelf arrangement 12 comprises a flat horizontal board-like portion, the shelf board 14, and, at a right angle to it and on each side of it, suspension members 16 (on left) and 16' (on right). These suspension members, indicated in approximate overall triangular shape, include each near its uppermost edge a right-angle extension in form of a flat tab (oriented in the vertical plane of the window) which are the ears 18 and 18'. Ear 18 extends from the left suspension member 16 to the left side of the shelf arrangement 12 and ear 18' extends from the right suspension member 16' to the right side of the shelf arrangement 12. Each ear 18 and 18' engages in the respective side sash channel 30 and 30'. Shelf board 14 incorporates at a short distance from its rearmost horizontal edge a strip-like member 19 whose rearmost vertical face forms a "horizontal" seat 20 which seats the assembly in a horizontal direction. Strip-like member 19 protrudes somewhat below the bottom surface of board 14. This is indicated in dashed lines in FIGS. 1 and 2 and is shown in section in FIG. 3. The location and extension of member 19 in the horizontal direction is of no particular importance. For instance, member 19 may be located approximately centrally, as shown, and extend for approximately half of the width of the entire shelf arrangement, or it may be somewhat shorter, or it may extend over the entire width. Alternately, member 19 may consist of two or more length-sections, located preferably, but not necessarily so, symmetrically on either side of the middle, and may even consist of only a pair of very short sections, of the order of the thickness of the suspension member 16 or the board 14 or less, each being located at one extreme end of board 14.

In order for the upper surface of the shelf board 14 of the shelf arrangement 12 to be oriented horizontally, when mounted on window 10, the rear-facing vertical surface of member 19 is arranged to be substantially in the same vertical plane as the front facing vertical surfaces of ears 18 and 18' respectively. Whereas minor departures from horizontal orientation of board 14 may be tolerable, it is best if the construction of the shelf arrangement makes provision to compensate for play of the sash in its sash channels by means of appropriate adjustments of the location of the rear-facing vertical surface location of the horizontal seat 20 in relation to ears 18 and 18'. Thus the rear-facing vertical surface of member 19 may be advantageously arranged to be closer to the window by the amount of free play of the lower sash 36 in its channels 30 and 30'. As this play may vary from window to window, provision may be made by padding, for instance by means of adhesive padding strips from appropriate materials and thicknesses fastened to the rear-facing surface of member 19 to adapt the arrangement to different windows. The described needed dimensional relationships may be appreciated in view of the sectional view of the mounted shelf arrangement in FIG. 3 which shows relative locations of the indicated shelf arrangement and window members. These relationships will be further clarified in the description of subsequent illustrations.

The width of the shelf arrangement 12 between the outside faces of the suspension members 16 and 16' is equal to or slightly less than the horizontal distance between the inside stops 44 and 44' of the window. Ears 18 and 18' extend beyond this width, each by a distance equal to or somewhat less than the depth of the sash channel 30 or 30' respectively. Ears 18 and 18' indicated in FIG. 1 by dotted outlines, as they are located within the sash channels and are thus not visible, are hooked in or engaged in the sash channels 30 and 30' which can also be visualized from FIG. 3. The shelf arrangement 12 may extend horizontally from the window for any reasonable practical distance, provided that loading and strength capabilities of the entire arrangement are not exceeded. Particularly in FIGS. 2 and 3, it can be seen that the rearmost portion of the shelf board 14 extends toward the window beyond the rearmost edges of suspension members 16 and 16'. The bottom surface of this extension serves as a "vertical" seat 22 for the purpose of vertically transferring the weight of the shelf arrangement 12 onto the top surface of the lower sash top rail 38. Similarly to the considerations described in regard to the location and extension of the strip-like member 19 and therewith also of the horizontal seat 20, vertical seat 22 need not extend along the entire rear edge of board 14, but may be of lesser width and centrally located, or it may be in the form of two or more shorter length extensions, symmetrically arranged, and it may even consist of only a pair of very narrow extensions, of the order of the thickness of the suspension member 16 or the board 14 or less, each being located at one extreme end of board 14 in the region of the suspension members 16 and 16'.

Even though the schematic depictions of the shelf arrangement 12 in FIGS. 1, 2, and 3 indicate a one-piece unitary construction, the design applies equally well to an assembly of individual parts appropriately fastened together. Thus for instance, a unitary construction of the shelf arrangement may be of a single piece of appropriately shaped and heat-formed sheet plastic, whereas a construction from several individual parts may utilize plastic or metal or wood components. One would well visualise, for instance, an assembly consisting of suspension members (16, 16') made from wood with ears (18, 18') made from sheet metal and fastened onto the wooden suspension members with screws, shelf board 14 made from sheet plastic or board wood and screwed to the suspension member with the vertical seat 22 as part of the board, and member 19 with horizontal seat 20 in form of a wood molding fastened onto the bottom of the board 14 with nails or screws, or in form of an appropriate step routed into the bottom rear edge of board 14.

Whereas the depictions of the shelf arrangement 12 in FIGS. 1, 2, and 3 are intended to be of a schematic nature particularly for the sake of clarification of the principal elements important to the present invention, these depictions nevertheless exemplify actual practical embodiments, for instance the ones described above.

The shelf arrangement 12, for example as shown in FIG. 2, is simply and easily installed on a window 10, as shown in FIG. 1, by lifting the shelf arrangement to a position somewhat above the lower sash 36 in an orientation slightly tilted (left to right or vice-versa) from the horizontal plane with the board edge farthest from the window tilted slightly upward and by first engaging the now lower of the two ears 18 and 18' into the appropriate sash channel 30 (respectively 30'). While gradually levelling the shelf arrangement 12 horizontally, the second ear is now engaged into the other sash channel and the entire shelf arrangement, which should now be oriented with its board 14 approximately in a horizontal plane, is lowered until it is seated with its vertical seat 22 on the upper surface of the lower sash top rail 38. Simultaneously, the horizontal seat 20 is seated against the front face of the lower sash top rail, as clearly shown in FIG. 3. Objects may now be placed on the shelf arrangement 12, as desired and intended. Removal of the shelf arrangement is simply achieved by reversing the order of the steps of the installation procedure described above. As can be seen from FIGS. 1 and 3, the upper sash 34 may be opened as desired while the shelf arrangement is installed.

Figure 4:
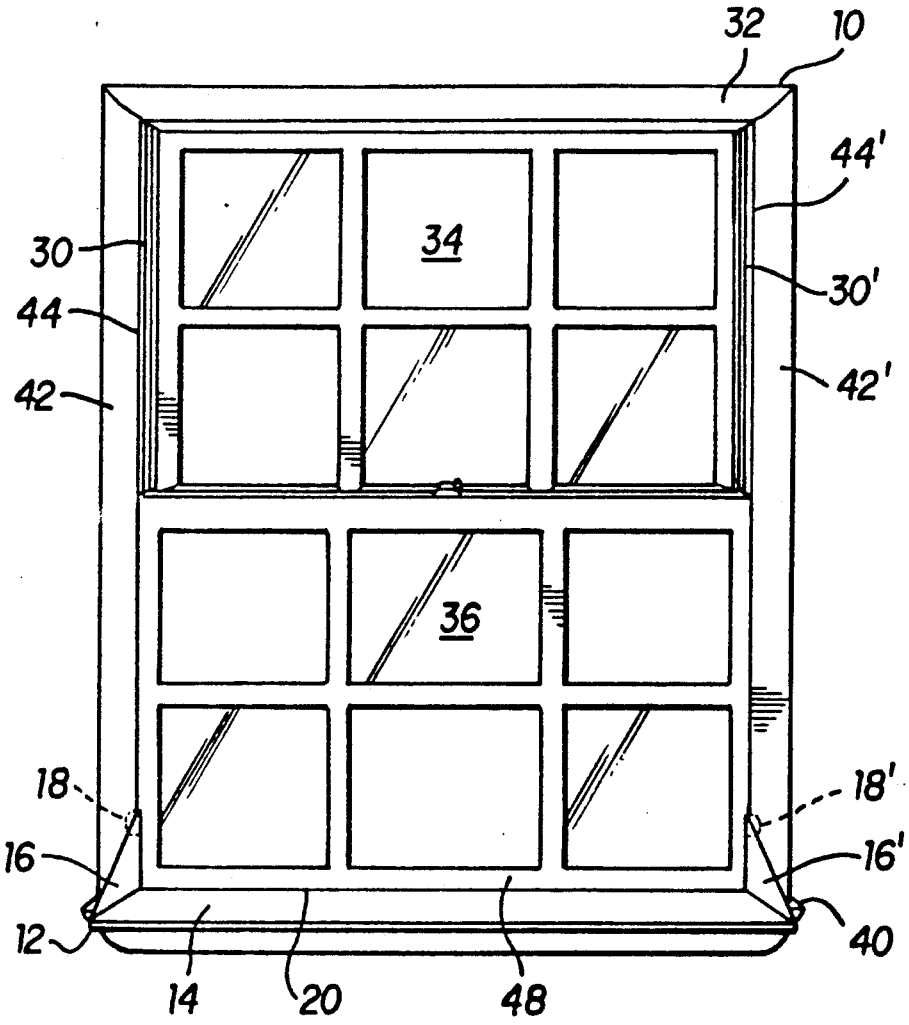
FIG. 4 is a schematic perspective frontal view of a sash window with a shelf arrangement incorporating the shelf suspension member of the present invention installed in a location on the window stool.

FIG. 4 illustrates schematically the same window 10 as shown in FIGS. 1 and 3, but with a shelf arrangement 12 incorporating the shelf suspension member of the present invention installed near the bottom of the window on the window stool 40 when the lower sash 36 is in its closed position. Upper sash 34 is shown in its closed position, although it could be open or anywhere in between. Components of the window 20 in FIG. 4 are identical to those of window 10 shown in and described in conjunction with FIG. 1 and carry the same reference numerals. In addition, the reference numeral 40 is applied to the so-called window stool, which is located at the bottom inside of the window structure, and the reference numeral 48 applies to the so-called lower sash bottom rail.

Figure 5:
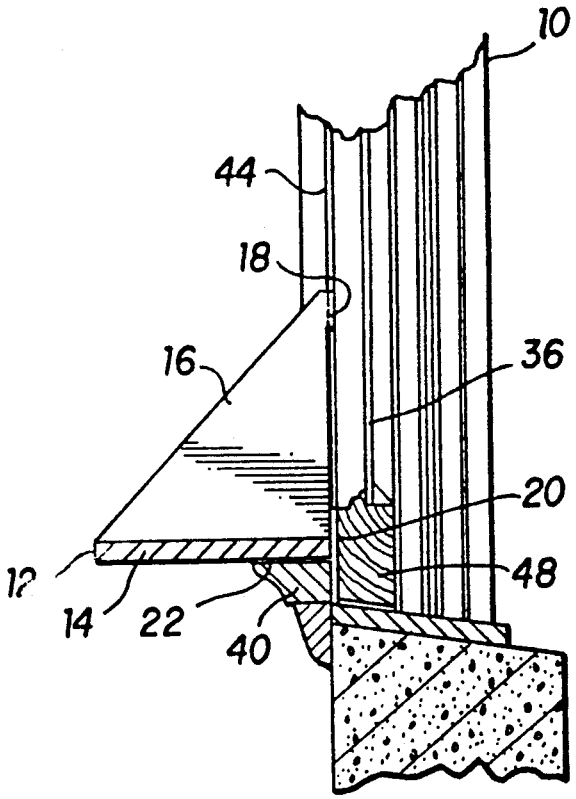
FIG. 5 is an enlarged schematic partial side sectional view of a typical sash window structure in the region of the stool with a sectional view of the installed shelf arrangement incorporating the shelf suspension member of the present invention, as indicated in FIG. 4.

Shelf arrangement 12 in FIG. 4 is best described in conjunction with its schematic side sectional view included in FIG. 5, which shows arrangement 12 installed on window 10. Only the portion of the window structure in the region of the stool 40 is depicted in sectional view in FIG. 5. Shelf arrangement 12 comprises a flat horizontal board-like portion, the shelf board 14, and, at a right angle to it and on each side of it, suspension members 16 (on left) and 16' (on right). These suspension members, indicated in approximate overall triangular shape, include each near its uppermost edge a right-angle extension in the form of a flat tab (oriented in the vertical plane of the window) which are the ears 18 and 18'. Ear 18 extends from the left suspension member 16 to the left side of the shelf arrangement 12 and ear 18' extends to the right side of the shelf arrangement 12. Ears 18 and 18' engage in the respective side sash channels 30 and 30' in the gap given by the difference between the width of the sash channels and the thickness of the lower sash 36 as also indicated in FIG. 5. The rear edge surface of shelf board 14 serves as the horizontal seat 20 which leans against the front face of the lower sash bottom rail 48, when the arrangement is installed on the window. The rear portion of the bottom surface of shelf board 14 serves as the vertical seat 12 which rests on stool 40, when the arrangement is installed on the window.

It should be noted that the shelf arrangement 14 illustrated in FIGS. 4 and 5 is essentially identical to the arrangement shown in FIGS. 1 to 3, except that the locations and shapes of horizontal seat 20 and vertical seat 22 are adapted to the installation position on the stool 40 of window 10. Seats 20 and 22 respectively serve the same functions in the embodiment shown in FIGS. 1 to 3 as in the embodiment shown in FIGS. 4 and 5. Furthermore, it can be appreciated that an appropriate reduction of the rear extension of board 14 which serves as vertical seat 22 in the embodiment of FIGS. 1 to 3 will adapt this shelf arrangement for appropriate use for the installation indicated in FIGS. 4 and 5, whether or not member 19 (of FIGS. 1 to 3) is retained. Such a reduction would have to result in the alignment of the rearmost vertical face of board 14, namely the horizontal seat 20, with the vertical plane established by ears 16 and 16'. It can be further appreciated, in view of the preceding presentation, that the considerations and descriptions in connection with the embodiment of FIGS. 1 to 3 apply also to the embodiment of FIGS. 4 and 5 when appropriately transposed in the aspects relating to the different mounting location on a window. Similarly, analogous installation and removal procedures apply.

Figure 6:
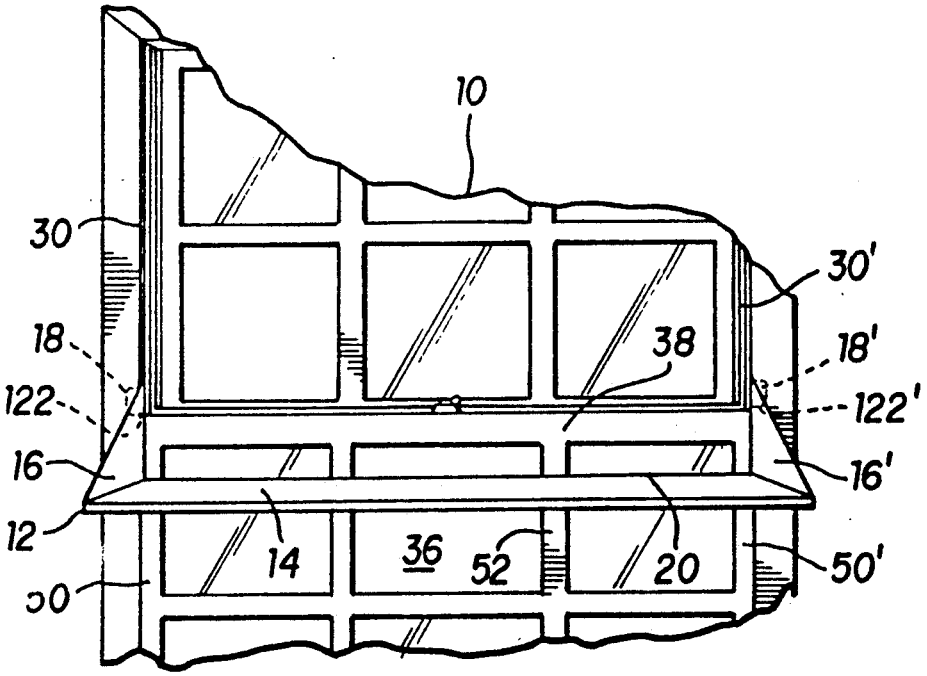
FIG. 6 is a schematic perspective front view of a sash window with a shelf arrangement incorporating the shelf suspension member of the present invention installed below the approximate middle of the window.
Figure 7:
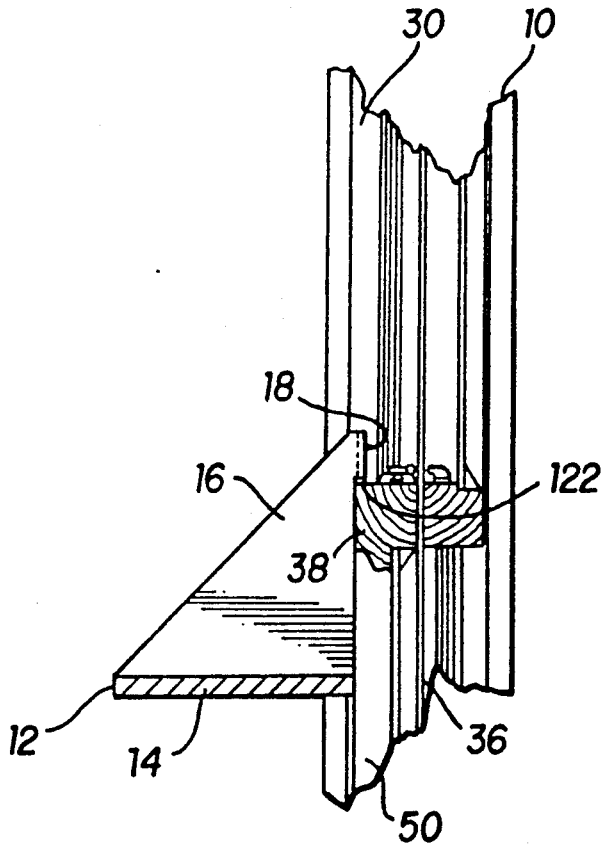
FIG. 7 is an enlarged schematic partial side sectional view of a window structure in the region of the middle of the window with a sectional view of the installed shelf arrangement incorporating the shelf suspension member of the present invention, as shown in FIG. 6.

FIGS. 6 and 7 show an embodiment of the present invention whereby the shelf arrangement 12 is installed and mounted on a window 10 in a location below the approximate middle of the the window. Specifically, the shelf arrangement 12 in FIGS. 6 and 7, which is substantially identical in constructional aspects to the arrangement 12 of FIGS. 4 and 5, is suspended with its ears 18 and 18' engaged in sash channels 30 and 30' respectively. Bottom edge faces of ears 18 and 18' serve as the vertical seat, which is now in two parts and thus shall be designated vertical seat 122 (on left side) and vertical seat 122' (on right side). These vertical seats rest on the upper surface of the lower sash top rail 38 largely within the sash channel regions of left sash channel 30 and right sash channel 30' respectively. Vertical seats 122 and 122' transfer the weight of the shelf arrangement and of any load carrier to the upper surface of the lower sash top rail 38. The rearmost vertical surface of shelf board 14 serves as horizontal seat 20 in the same manner as already described in connection with FIGS. 4 and 5, except that it now leans against the two vertical side members of the lower sash 36, the side member 50 (on left) and the side member 50' (on right), and it might also lean against front surfaces of the so-called muntins 52, it present on a particular window and if not recessed away from the front face of the lower sash. Similarly, the same considerations described in conjunction with FIGS. 1 to 3 in regard to adjustments of the location of horizontal seat 20 in relation to ears 18 and 18' apply to all embodiments of the present invention. Also installation and removal procedures are analogous.

Figure 8:
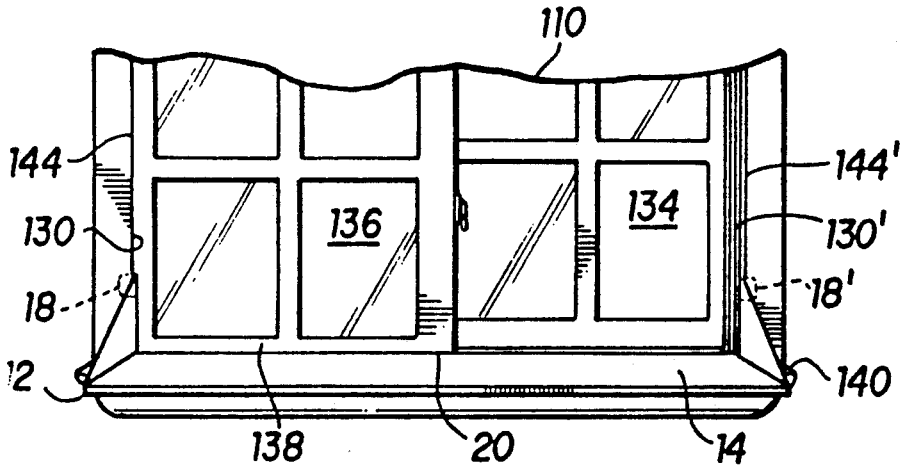
FIG. 8 is a schematic perspective front view of a horizontal sash window with a shelf arrangement incorporating the shelf suspension member of the present invention installed in a location on the window stool.

FIG. 8 shows schematically another embodiment of the present invention whereby the shelf arrangement 12 is installed on a horizontal sash window 110 in a location on the window stool 140. This embodiment is analogous to the embodiment described in conjunction with FIGS. 4 and 5, except that the window is of the horizontal sash type. The shelf arrangement 12 itself is in all aspects identical to the one of FIGS. 4 and 5. Analogous installation procedures apply. The difference in the window type has no bearing on the construction and use of the shelf arrangement per se, except as given by the slightly different use of this window and by the shelf arrangement's different engagement with and mounting on different window components. Insofar as such engagement and mounting is concerned, ears 18 and 18' engage into side channels 130 and 130' respectively, whereby such side channels are parts of the standard structure of the frame of window 110. Specifically, left ear 18 engages side channel 130 in the gap given by the difference between the width of the left side channel 130 and the thickness of the left sash 136. Left sash 136 is rarely moved all the way into the right side channel 130', even though the installed shelf arrangement would permit this, as also the right ear 18' requires for engagement only the width (or less) of the gap analogous to the said gap on the left side. Horizontal seat 20, given by the rearmost vertical edge face of shelf board 14, leans against the horizontal bottom member 138 of left sash 136, whether the sash is closed, as shown, or in any other position. Right sash 134 may be opened without affecting the installed shelf arrangement in any way.

Shelf arrangement 12 seats onto window stool 140 in the same manner as described for the embodiment shown in FIGS. 4 and 5 (wherein the reference numeral 40 designates the window stool for the vertical sash window 10).

Figure 9:
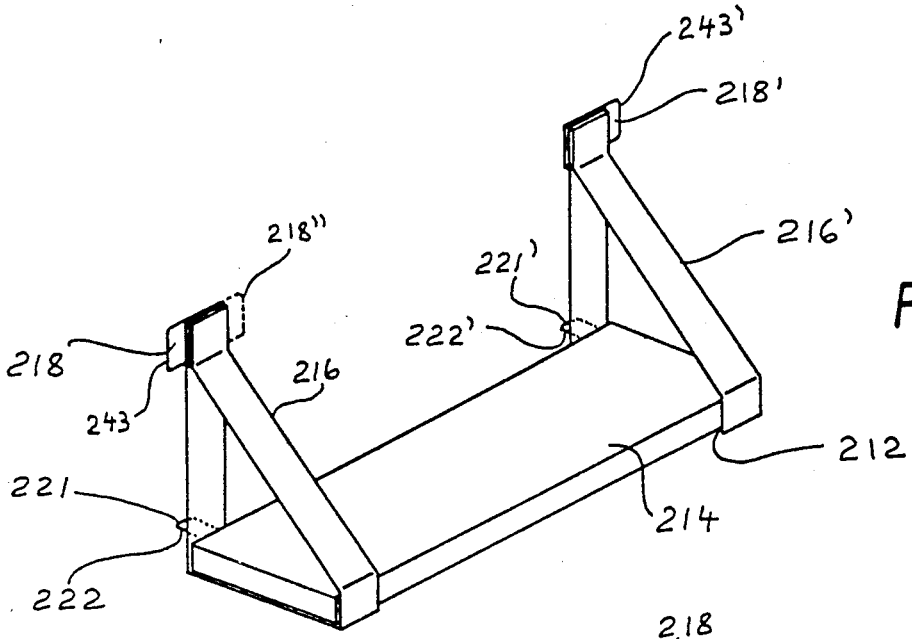
FIG. 9 is a schematic isometric view of a preferred embodiment of a shelf arrangement incorporating a shelf suspension member of the present invention.
Figure 10:
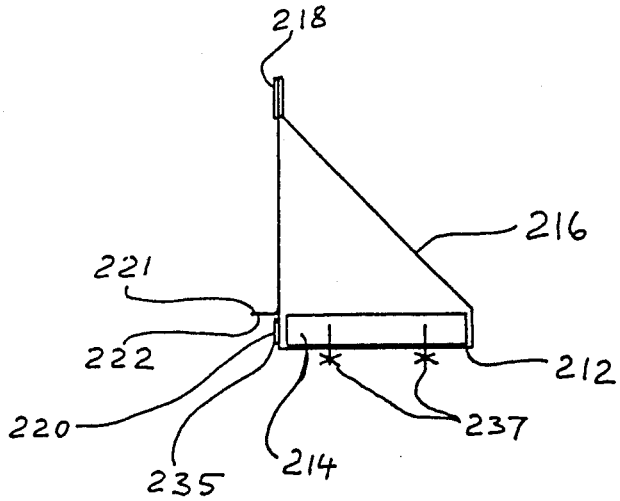
FIG. 10 is a schematic side view of the arrangement of FIG. 9.

A preferred embodiment of the shelf arrangement incorporating the shelf suspension member of the present invention is schematically depicted in FIGS. 9 and 10, whereby the shelf arrangement 212 is an assembly of individual parts. Arrangement 212 comprises suspension members 216 (on left side) and 216' (on right side) and shelf board 214 fastened with, or instance, two screws 237 into each suspension member. This assembly forms a rigid structure, not unlike the structure shown in conjunction with preceding FIGS. 1 to 8. Furthermore, basic elements of this assembly are identical or analogous to the basic elements of the preceding embodiments described, and similar if not identical considerations apply.

Board 214 serves with its upper surface as the shelf platform to carry objects as desired. Additionally, board 214 serves to structurally tie together the two suspension members 216 and 216'. Members 216 and 216' are fastened to the board, each at one extreme end of it. The length of the board 214 and thusly also the corresponding width of the shelf arrangement 212 to suit a particular width window is determined by considerations described already in conjunction with the embodiment of FIGS. 1 to 3, whereby these considerations apply to all embodiments of the present invention. The width of the entire shelf arrangement must fit between a window's left and right inside stops (44 and 44' in FIGS. 1 to 7; and also corresponding to 144 and 144' in FIG. 8), as well as having its ears 218 and 218' engage into respective left and right channels of the window structure (30 and 30' in FIGS. 1–7; and 130 and 130' in FIG. 8), with appropriate clearance to facilitate installation on and removal from a window. One particular advantage of the shown shelf arrangement 212 comprising board 214 as a separate component is the ease of adaptation of the arrangement to windows of different widths. By utilization of different appropriate board length together with standard members 216 and 216', such adaptation is achieved with utter simplicity and practicality.

Suspension members 216 and 216' are mirror images of each other in regard to the direction of extension of ears 218 (to left) and 218' (to right). Members 216 and 216' are shown to form of flat strip bent into a triangular-like box structure, wherein the strip ends are fastened together also with the respective tab-like ear 218 and 218' respectively. Not illustrated in FIG. 9, but indicated in FIG. 10 by screws 237, are the fastening means which join members 216 and 216' to the board 214, as indicated. The depth of board 214, at least in the region where it is inserted into and fastened onto members 216 and 216', is preferably slightly less than the lower side of the box structure to facilitate assembly (it may be any practically usable smaller dimension). It will be apparent that the board 214 may also be made considerably deeper by extension of its front facing side in the region between members 216 and 216'. Short tab-like horizontal protrusions, the vertical seat tabs 221 and 221', extend from the rear face of each suspension member 216 and 216' respectively in such a location that the lower surfaces of the tabs lie in the plane of the upper surface of board 214. This particular location provides for the top surface of board 214 to be at the same level as the top surface of the lower sash top rail 38 (for instance of window 10 in FIGS. 1 and 3) if the shelf arrangement 212 were installed, for example, in the middle window position similar to the one shown in FIG. 1. Consequently, the usable shelf depth is extended rearward by a portion of the top surface of the lower sash top rail. However, vertical seat tabs 221 and 221' may also be higher or lower to obtain different shelf arrangement levels in relationship to the window structure.

Rear vertical faces of suspension members 216 and 216' below vertical seat tabs 221 and 221' may have, but need not necessarily have, attached thereto small flat pads 235 and 235' for alignment purposes in regard to horizontal seats 220 and 220' (235' and 220' are not specifically shown, but their presence should be understood in the respective locations on the right suspension member 216'). Such alignment considerations have already been described in conjunction with the embodiments of FIGS. 1 to 8. Vertical rear surfaces of pads 235 and 235' represent horizontal seats 220 and 220' respectively. Rear vertical surfaces of members 216 and 216' below vertical seat tabs 221 and 221' represent horizontal seats 220 and 220' if these pads 235 and 235' are not required.

As already described in conjunction with FIGS. 1-5 and 8 in regard to the function of vertical seats 22 (and 122 and 122' in FIGS. 6 and 7), when installed, the wight of the shelf arrangement with its load is transferred to the respective window structure components via these vertical seats. The function of these vertical seats corresponds to the function of vertical seats 222 and 222' described in conjunction with FIGS. 9 and 10.

As also already indicated in conjunction with FIGS. 1-5 and 8 in regard to the function of the horizontal seats 20 (and 120 and 120' in FIGS. 6 and 7), when installed, the tilting forces, given by the cantilevered mounting of the shelf arrangement incorporating the shelf suspension member of the present invention, are transferred to the respective window structure components, on one hand, in form of one part of the tilting force couple via these horizontal seats and, on the other hand, in form of the other part of the tilting force couple via the described front-facing surfaces of the ears 18 and 18'. The function of these horizontal seats corresponds to the function of horizontal seats 220 and 220' described in conjunction with FIGS. 9 and 10. The function of the front-facing surfaces of ears 18 and 18' of FIGS. 1 to 8 corresponds to the function of the front-facing surfaces of ears 218 and 218' of FIGS. 9 and 10.

It will be apparent that, with the exception of some structural details, the present embodiment of FIGS. 9 and 10 is substantially analogous in basic aspects, in its basic elements, in its installation procedure, its function and use, and in other considerations to embodiments presented in conjunction with the preceding illustrations. Consequently, only such further details are described here, as may add to the understanding or as may disclose aspects of the present invention which may not have been clarified to this point.

The shelf arrangement 212 of FIGS. 9 and 10, which is particularly suited to mounting approximately in the middle of a vertical sash window on the lower sash top rail, may be converted to suit installation in other described window locations by simply removing vertical tab seats 221 and 221'. As a practical matter, these tabs may be of the break-away type to facilitate such adaptation and conversion. Removal of these tabs transfers the described duty of the vertical seats (of transferring the arrangement's weight onto appropriate window components) to either the rear bottom surfaces of members 216 and 216', as used in installations on window stools, to the bottom edge surfaces of ears 218 and 218' for mounting whereby the shelf arrangement is suspended below the middle of the window from the upper surface of the lower sash top rail.

Ear 218'' indicated by dashed lines in FIG. 9 is identical to ear 218, except for its locations on the opposite side of member 216 and its extension in the opposite direction from member 216. Suspension member 216 may thusly be provided with an ear on each side of it, as indicated, to permit it to serve interchangeably on either side of arrangement 212.

Figure 11:
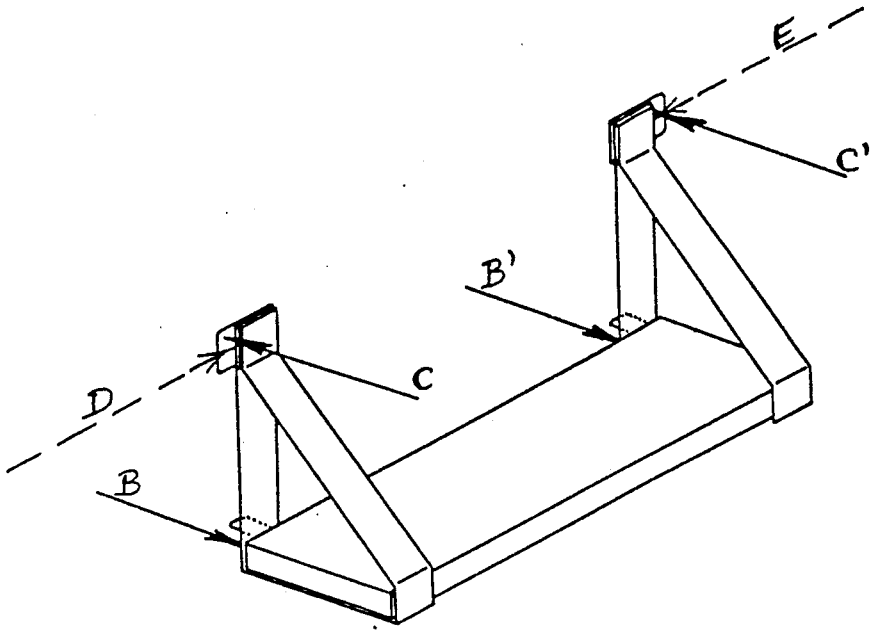
FIG. 11 and FIG. 12 are identical to FIG. 9 and FIG. 10 respectively, but additionally indicate approximate positions and directions of the reaction forces experienced when the shelf arrangement is installed.
Figure 12:
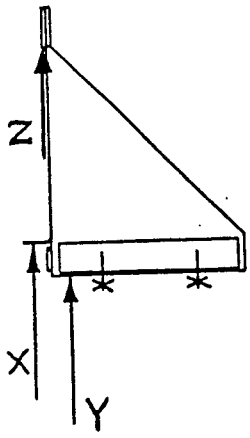

FIGS. 11 and 12 are identical to FIGS. 9 and 10 in the schematic depiction of the structure of the shelf arrangement shown. These structures have been chosen as representative examples only. The validity of the following description is not intended to be limited to these structures, but is intended to be analogously, if not identically, applicable to all embodiments of the present invention. Reference numerals to the various components have been omitted for clarity's sake and, instead, force vectors acting on various parts in different locations are schematically indicated. These force vectors correspond to reaction forces exerted by appropriate window structures onto the respective components of the shelf arrangement when it is installed on a window.

The term "basic-function elements" has been chosen here to refer to those components or surfaces of a shelf arrangement incorporating the shelf suspension member which directly transfer such forces or reaction forces (force vectors) between the shelf arrangement and the window components. Aside from obvious considerations in regard to appropriate strength and rigidity and other pertinent design criteria for the shelf arrangement structure itself, basic-function elements of the shelf arrangement in regard to its cantilevered suspension on window structures and thus its force contact and force transfer points or regions are of fundamental significance and are, therefore, specifically described here in conjunction with FIGS. 11 and 12. Reference will also be made to FIGS. 9 and 10 in regard to designations of particular components.

Vector X in FIG. 12 represents the force supporting the weight of the shelf arrangement on a window via vertical seats 222 and 222' (located on vertical seat tabs 221 and 221'). The alternate vector Y represents this same force in embodiments wherein vertical seat tabs 221 and 221' are absent and when the rear bottom surfaces of members 216 and 216' serve as vertical seats.

The further alternate vector Z represents this same force in embodiments with vertical seat tabs absent, but wherein a shelf arrangement is suspended below the middle of a window, as described before, whereby the bottom edge surfaces of ears 218 and 218' support the arrangement's weight.

It will be apparent from the preceding descriptions of various embodiments that each of the forces discussed here may be transferred via one or more components. For instance, FIGS. 1 through 8 show each a vertical seat in form of a single surface which serves to transfer the weight of the arrangement, yet the same function is served by the two vertical seats 222 and 222' in FIG. 9 and 10 (for instance, indicated by vector X in FIG. 12). Similar considerations apply to the two forces of the tilting force couple.

As indicated in FIG. 11, Vectors B and B' represent one part and vectors C and C' represent the other part of the tilting force couple. As already described before, forces given by vectors B and B' are transferred to the shelf arrangement via horizontal seats 220 and 220' and forces given by vectors C and C' are transferred to the shelf arrangement via the front surfaces of ears 218 and 218'.

Restraints on horizontal movement of a shelf arrangement are indicated in FIG. 11 as dashed-line arrows D and E. Whereas these restraints become actual reaction forces when a shelf arrangement experiences a sideways-directed externally applied displacement force, in normal use frictional effects will restrain the arrangement from horizontal movement from side-to-side within the play of the mounting up to the frictional limit. Restraining forces (when acting) represented by vectors D and E are substantially transferred via the rear left side of member 216 and/or the left vertical edge side of ear 218 (vector D) and via the rear right side of member 216' and/or the right vertical edge side of ear 218' (vector E).

In view of the description given in conjunction with FIGS. 11 and 12, the basic-function elements of the cantilevered shelf arrangement incorporating the shelf suspension member are defined as: (1) the described weight-bearing means, (2) the described tilting force couple bearing means, and (3) the described restraining force means. These basic-function elements are represented in the description of the embodiments of the present invention by (1) the vertical seats (e.g. 222 in FIG. 10), (2) the horizontal seats (e.g. 220 in FIG. 10) and the vertical front surface of the ears (218 in FIG. 10), and (3) the above described left and right sides of the left and right suspension members (e.g. 216 and 216' in FIG. 9) and or/the outside surfaces (243 and 243' in FIG. 9) of the left and right ears respectively.

Figure 13:
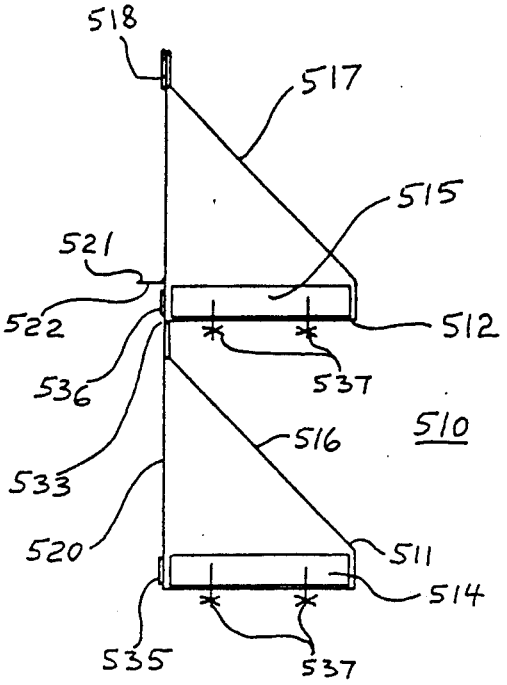
FIGS. 13 to 15 are schematic side views of double-shelf embodiments of the present invention.

The schematic side view of s double-shelf arrangement 510 shown in FIG. 13 comprises two shelf arrangements, one above the other, wherein each is substantially similar to shelf arrangement 212 of FIGS. 9 and 10. Lower shelf arrangement 511 and upper shelf arrangement 512, as shown, are one structure, since their lower suspension member portion 516 and their upper suspension member portion 517 are joined. This may be achieved by conventional fastening methods in the joint region 533, for example by welding, riveting, etc., or the entire double-box structure comprising member portions 516 and 517 may be fabricated in one piece, for instance by appropriate bending of strip material. Lower shelf board 514 and upper shelf board 515 are fastened, for instance by screws 537, near each extreme end of the boards to the respective suspension member portions, as shown. It will be apparent, in view of preceding descriptions and illustrations, that arrangement 510 comprises mirror image components to the ones visible in FIG. 13, and no specific reference will be made to such components, although their presence should be understood as a matter of course.

As depicted in FIG. 13, whereas the upper suspension member portion 517, including board 515, is identical to the arrangement of FIGS. 9 and 10 (except for being joined to the lower suspension member portion 516), the lower suspension member portin 516 is shown to be without an ear (upper suspension member portion incorporated ear 518) and without a vertical seat tab (see vertical seat tab 521 with its vertical seat 522 on member portion 517 in FIG. 13).

The double-shelf arrangement 510 is suited to installations in the middle of windows in the manner depicted in FIGS. 1 to 3 and also described in conjunction with FIGS. 9 and 10, whereby described mounting aspects are to be understood to apply to the upper shelf arrangement 512 of FIG. 13. However, as lower shelf arrangement 511 is suspended below arrangement 512, even though and because both portions are rigidly joined, the rearmost surface of the lower suspension member portion 516 serves as an extension of horizontal seat 520. Thusly, horizontal seat 520 includes the entire vertical rearmost surface presented by the joined suspension member portions 516 and 517 below vertical seat tab 521. Previously described pads (for instance pads 235 in FIG. 10) may be also present here for analogous purposes. They are indicated in FIG. 13 as the lower pad 535 and the upper pad 536. As previously discussed, if required for alignment purposes, such pads take on the function of the horizontal seat 520. Consequently, seat 520 will be in two parts as indicated in FIG. 13, although more than two pads or one (or none) may be utilized.

In view of the description in conjunction with preceding illustrations, particularly in connection with various installation locations of shelf arrangements on a window, it will be apparent that the shelf arrangement 510 of FIG. 13 is analogously adaptable to different mounting locations. For instance, removal or absence of vertical seat tab 521 will facilitate mounting of the arrangement 510 on the stool of a window, whereby the function of vertical seat 522 is taken on by the vertical bottom rear surface of lower suspension member portion 516. Or the arrangement 510 may be suspended from the middle of the window in the manner described in conjunction with FIGS. 6 and 7. Furthermore, moving vertical seat tab 521 from its location shown in FIG. 13 on the back of the upper suspension member portion 517 to the analogous location on the lower suspension member portion 516, arrangement 510 may be mounted to seat on top of the lower sash top rail to a large extent in front of the top half of the window.

Figure 14:
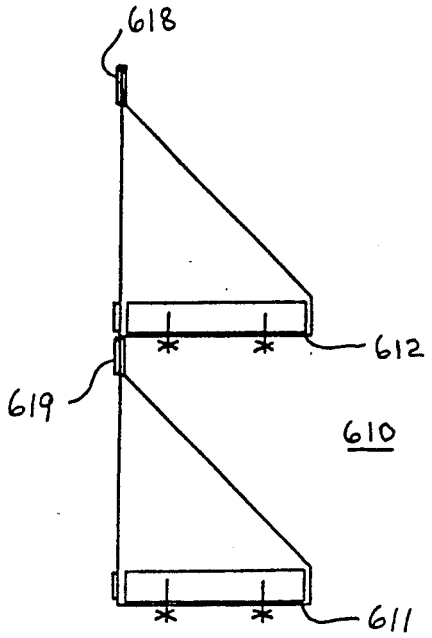

FIG. 14 depicts a double-shelf arrangement 610, similar to the arrangement 510 of FIG. 13, except that vertical seat tab or tabs are absent and that the lower shelf arrangement 611 and the upper shelf arrangement 612 are identical separate components which are not mechanically joined together. Upper arrangement 612 supports its weight via its rear portion of the vertical bottom surface on the uppermost edge surface of the lower arrangement 611. Each of the two arrangements is equipped with an appropriate ear (upper ear 618 and lower ear 619) which, when the arrangement is installed, engages appropriate sash channels of a window.

It will be apparent, in view of the descriptions in conjunction with various illustrations, that this arrangement 610 is suited to installations on the stool of a window, whereby the upper shelf arrangement 612 supports its weight on the lower shelf arrangement 611, and the weight of the entire arrangement 610 rests on the window stool with the rear portion of the bottom surface of arrangement 611. It can be appreciated also that the lower shelf arrangement 611 may be replaced by the shelf arrangement 212 of FIGS. 9 and 10 (which also incorporate vertical seat tab 221) in order to facilitate installation on the top surface of the lower sash top rail, as for instance exemplified by FIG. 1.

Figure 15:
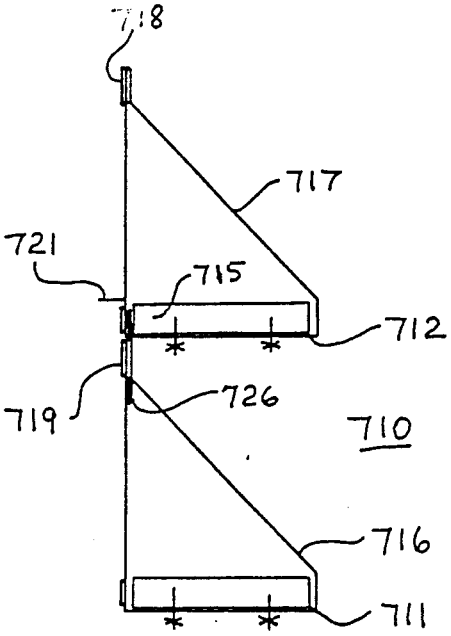
Figure 16:
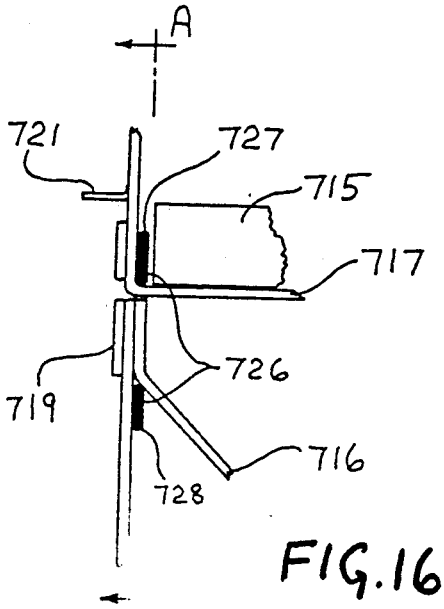
FIG. 16 is an enlarged partial view of the connection region between the shelf arrangements of FIG. 15.
Figure 17:
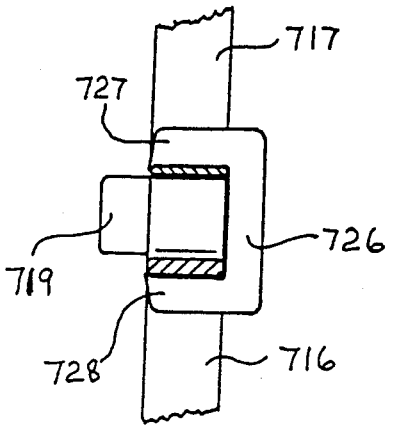
FIG. 17 is a partial sectional view taken along the line 'A'—'A' of FIG. 16.

FIGS. 15, 16, and 17 schematically depict another embodiment of the present invention, specifically another double-shelf arrangement 710, wherein the lower shelf arrangement 711 is suspended from and below the upper shelf arrangement 712 by means of an appropriate intermediate link member 726 to be further described shortly. Upper shelf arrangement 712 is identical to the shelf arrangement 212 of FIGS. 9 and 10, and appropriate descriptions given in conjunction with these FIGS. are applicable. Installation of arrangement 710 on a window in the manner shown in FIG. 1 is similarly applicable as it would refer to the mounting of its upper shelf arrangement 712. Also the installation possibility described in conjunction with FIGS. 9 and 10 is applicable here, wherein vertical seat tab 221 is removed or absent. This installation position is shown in FIG. 6.

The lower shelf arrangement 711 is identical to either of the two arrangements shown in FIG. 14, and the description given in conjunction with FIG. 14 are analogously applicable.

The lower shelf arrangement 711 is linked to the upper shelf arrangement 712 by an approximately C-shaped link member 726 which serves to suspend and carry the weight of arrangement 711; thus transferring the weight from the lower suspension member 716 to the appropriate support, which is now vertical seat tab 721 of the upper suspension member 717. As depicted in FIGS. 15, 16, and 17, link member 726 is a substantially C-shaped part from flat material oriented in the vertical plane substantially parallel to the rearmost faces of suspension members 716 and 717. The upper leg 727 of link member 726 engages in the gap between upper shelf board 715 and the adjacent vertical rear portion of upper suspension member 717, and the lower leg 728 of link member 726 engages in the upper corner region of the lower suspension member 716. It is preferable, but not essential, that link member 726 be engaged tightly such that upper and lower shelf arrangements are held together with some force providing adequate friction effect to prevent inadvertent disengagement of member 726. However, link member 726 may be shaped, for instance by having the ends of its legs each (or at least one of them) equipped with a slight protrusion (in the direction toward each other) to achieve its retention. Engagement of member 726 would require, in this case, slight forcing, utilizing the inherent elasticity of the material, until such protrusions snap in place just past the width of members 716 and 717. Alternately, any other conventional snap-in and retention mechanisms may, of course, be used. Link member 726 may be also sized to provide a loose or slack engagement such that a small gap exists between suspension member 716 and 717. Retention of link member 726 may then be achieved by forming the ends of legs 727 and 728 with more pronounced protrusions pointing toward each other. Thus engagement would be more like a hook-in action and retention of engagement would be achieved by the effect of the weight of the lower shelf arrangement 711 on the link member 726, which will not permit disengagement unless the lower shelf arrangement is lifted up and unhooked from the link member 726.

It will be clear that an arrangement as shown in FIG. 15 will require two link members 726, one for each side of the double-shelf arrangement 710. In view of descriptions presented in regard to the various embodiments, it will be clear that both the upper ear 718 of the upper shelf arrangement 712 and the lower ear of the lower shelf arrangement 711 have to be engaged in appropriate sash channels of a window in an installation.

Figure 18:
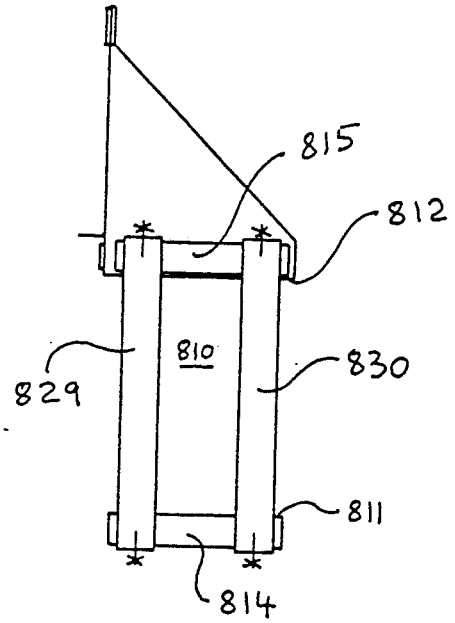
FIG. 18 is a schematic side view of another embodiment of a double-shelf arrangement incorporating the shelf suspension member of the present invention.
Figure 19:
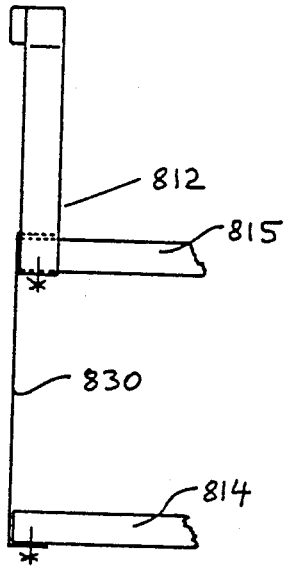
FIG. 19 is a view in third angle projection of a part of the arrangement shown in FIG. 18.

FIGS. 18 and 19 show schematically a further embodiment of a double-shelf arrangement 810 comprising an upper shelf arrangement 812, identical to the shelf arrangement 212 shown in FIGS. 9 and 10 in all respects described including installation possibilities and locations. The lower shelf arrangement 811 comprises the lower shelf board 814 which is suspended via relatively large approximately C-shaped identical links 829 and 830. The further required pair of such links at the other side of the shelf arrangement is not visible, but should be understood to be present as a matter of course. Links 829 and 830 are fastened by means of screws, as indicated, to the upper surface of board 815 and to the lower surface of board 814. In view of the exhaustive descriptions of various embodiments of the present invention in conjunction with the respective illustrations, all aspects of the embodiment of FIGS. 18 and 19 should be clearly apparent, and further description is deemed redundant.

Figure 20:
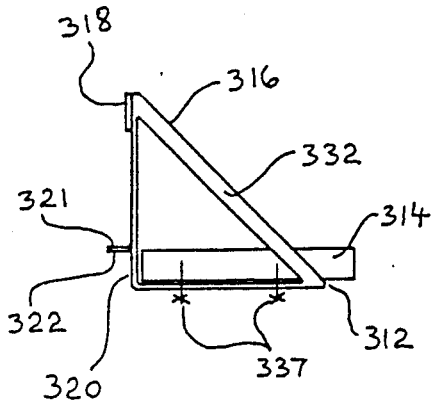
FIG. 20 is a schematic side view of a further embodiment of a shelf arrangement incorporating the shelf suspension member of the present invention.
Figure 21:
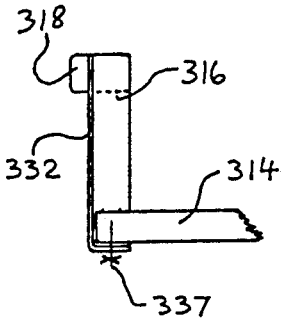
FIG. 21 is a view in third angle projection of a part of the arrangement shown in FIG. 20.

FIGS. 20 and 21 show schematically another embodiment of the present invention which is in most respects not unlike the embodiment of FIGS. 9 and 10. The significant difference is in that shelf board 314 may be of any practical depth including depths larger than the horizontal extension of suspension members 316. As depictions in FIGS. 20 and 21 show a side view and a partial front view of the shelf arrangement 312 only, only one suspension member (left side of arrangement) is visible. The actual presence of the respective components on the other side of the arrangement will be obvious, in view of preceding descriptions, and no special further reference will be made to such components.

Suspension member 316 incorporates the same components as member 216 of FIGS. 9 and 10, for instance ear 318, vertical seat 322 as the bottom face of vertical tab 321, etc. The shelf arrangement 312 comprises shelf board 314, fastened by means of screws 337 near each end of its length to a suspension member 316, whereby the left suspension member has its ear 318 protrude leftward and the right suspension member has its ear protrude rightward. Suspension members have again a generally triangular box-like structure. However, the strut 332, corresponding to the hypotenuse, is now in form of a thin flat strip with its plane in the vertical and located on the outer edge of the remaining structure of member 316, as clearly apparent from FIGS. 20 and 21. This permits use of deeper boards 314, as for instance specifically illustrated in FIG. 20, without a need for special cut-outs in the board. It will be apparent that removal or absence of vertical seat tab 321 (and thus its vertical seat 322) will facilitate other than middle-of-the-window installation locations, which have been described before in conjunction with various illustrations.

Figure 22:
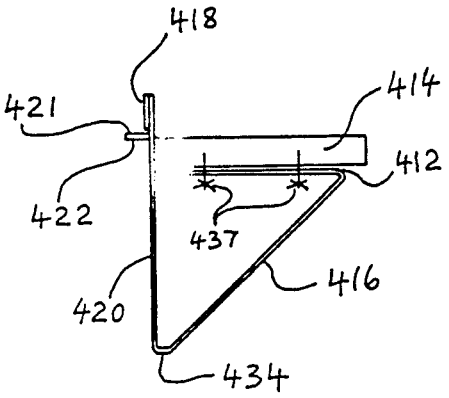
FIG. 22 is a schematic side view of another embodiment of a shelf arrangement incorporating the shelf suspension member of the present invention.
Figure 23:
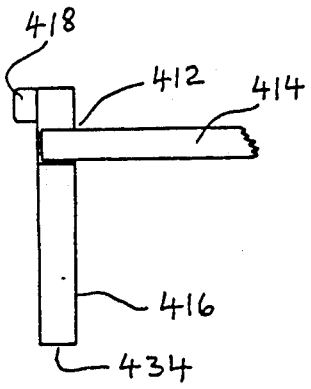
FIG. 23 is a view in third angle projection of a part of the arrangement shown in FIG. 22.

Another embodiment of the present invention is illustrated in FIGS. 22 and 23, wherein a shelf arrangement 412 for installation in the middle of a window, not unlike the installation shown in FIGS. 1 to 3, comprises a shelf board 414 fastened to suspension members 416 by means of screws 437. FIGS. 22 and 23 show only the left side of the shelf arrangement 412. It will be obvious, in view of the preceding descriptions, that the right side of the shelf arrangement is an exact mirror image of the left side. Contrary to preceding embodiments, shelf arrangement 412 has its board 414 arranged above suspension member 416. However, the same shelf arrangement components are present as described in conjunction with preceding embodiments, and the same basic function elements serve in the same manner, albeit in somewhat different relative positions. For instance, ear 418 is located only slightly above the upper surface of board 414 and the vertical seat tab 421 with its vertical seat 422 is also near the approximate level of board 414, whilst the function of the horizontal seat 420 is taken on by the lower back surface of member 416. This shelf arrangement 412 is suited to installation in the middle of a window with its vertical seat 422 resting on the lower sash top rail. Removal or absence of vertical seat tab 421 will facilitate installation in the same location as described in conjunction with FIGS. 6 and 7, namely suspension from the upper surface of the lower sash top rail, whereby the lower edge surface of ear 418 takes on the function of the vertical seat. Furthermore, removal or absence of vertical seat tab 421 will also facilitate installation on the stool of a window, as indicated in FIGS. 4 and 5, and also in FIG. 8. In this case, the function of vertical seat is taken on by the lowest horizontal surface 434 of member 416, which will rest on the window stool.

It will be apparent to those skilled in the art that various changes and modifications may be made without departing from the spirit and scope of the invention. For instance, although the descriptions have used installation locations on the "indoor" side of windows, "outdoor" locations may also be utilized. For example, a shelf arrangement of the invention may be located on the outdoor sill of a window for plants, bird-feeders, etc. Also, for instance, even though the descriptions have used installation on sash windows, installation on other types of windows with suitable mounting and engagement structures may be used. Further, whereas single and double shelf arrangements have been described, multiple shelf arrangements may be used.

The embodiments of the invention in which an exclusive property or privilege is claimed are defined as follows:

1. A shelf suspension member for holding a shelf and mounting on a window of the type having a grooved, vertical frame member including a vertical groove therein and a bottom sash and having at least one framed window pane that is slideable in a plane substantially coplanar therewith for opening and closing of said window, said shelf suspension member being affixable to said window in a cantilevered manner and comprising:

a vertical member including an upper end and an outer vertical surface;

a horizontal member joined at one end thereof to said vertical member;

an outwardly-extending ear including an inner surface, said outwardly-extending ear being rigidly and immovably affixed to said upper end of said vertical member, said inner surface being disposed substantially in the same plane as said outer vertical surface of said vertical member, said outwardly-extending ear being operative for entering into and engaging said vertical groove;

said outwardly-extending ear and at least a portion of said outer vertical surface of said vertical member being operative in combination as a tilting-force-couple-bearing means for supporting said shelf suspension member against tilting; and, said horizontal member being operative to support said shelf along a substantial length thereof;

wherein said vertical member includes a horizontally-extending seat tab member having an inner end attached to and projecting orthogonally from said outer vertical surface and having a free outer end, said horizontally-extending seat tab member being operative as a weight-bearing means for vertically supporting said shelf bracket.

2. The shelf suspension member according to claim 1, wherein said horizontally-extending seat tab member is a tab-like ear of the break-away type.

3. A shelf suspension member for holding a shelf and mounting on a window of the type having a grooved, vertical frame member including a vertical groove therein and a bottom sash and having at least one framed window pane that is slideable in a plane substantially coplanar therewith for opening and closing of said window, said shelf suspension member being affixable to said window in a cantilevered manner and comprising:

a vertical member including an upper and a lower end and an outer and an inner surface, said outer surface including a bearing surface portion extending for a distance therealong at least from said lower end upwardly;

a horizontal member having a proximal and a distal end, said horizontal member being joined at said proximal end to said lower end of said vertical member, said horizontal member including an upper and a lower surface, said upper surface being substantially flat and extending substantially continuously in a horizontal plane from said inner surface at said proximal end to said distal end, said lower surface being substantially flat and extending substantially continuously in a horizontal plane from said outer surface at said proximal end of said distal end;

an outwardly-extending ear rigidly and immovably contiguously joined to said outer surface of said vertical member at said upper end, said outwardly-extending ear including an inner vertical face and a lower edge, said inner vertical face being disposed substantially in the same vertical plane as the plane of said outer surface of said vertical member, said outwardly-extending ear being operative for entering into and engaging said vertical groove;

said inner vertical face of said outwardly-extending ear and said bearing surface portion of said outer surface of said vertical member being operative in combination as a tilting-force-coupled-bearing means for supporting said shelf bracket against tilting; and, said horizontal member, substantially along the entire length of said upper surface between said proximal and said distal end, being operative to support said shelf.

4. The shelf suspension member of claim 3, wherein said horizontal member includes means for assisting in fastening said shelf thereto.

5. The shelf suspension member of claim 3, wherein said lower edge of said outwardly-extending ear is operative as a weight-bearing means for vertically supporting said shelf suspension member.

6. The shelf suspension member of claim 3, wherein said vertical member includes a horizontally-extending seat tab member having an inner end attached to and projecting orthogonally from said outer surface and having a free outer end, said horizontally-extending seat tab member including a horizontal bottom face, said horizontally-extending seat tab member being operative as a weight-bearing means for vertical supporting said shelf suspension member while said horizontal bottom face is born upon a horizontal surface of said window.

7. The shelf suspension member of claim 6, wherein said horizontally-extending seat tab member is a tab-like ear of the break-away type.

8. The shelf suspension member of claim 3 including a vertical aligning pad affixed to said outer surface in the region of said bearing surface portion for aligning said shelf suspension member with respect to said window so that said upper surface is oriented substantially horizontally.

9. A pair of shelf suspension members for installing a shelf on a window of the sash type, said window having grooved vertical frame members each including at least one vertical groove, each of said shelf suspension members comprised of:

a suspension member substantially in the shape of a right triangle, said suspension member having orthogonal sides and being formed from flat strip material with a thin, substantially rectangular cross-section, said suspension member including:

a vertical member including an upper and a lower end and an outer surface;

a horizontal member joined at one end thereof to said lower end of said vertical member and having an inside and an outside surface, said inside and outside surfaces each being substantially flat and extending substantially continuously in a horizontal plane along the entire length of said horizontal member;

a diagonal member joined at a first end thereof to said upper end of said vertical member and at a second end thereof to the other end of said horizontal member;

vertical support means for supporting said suspension member against a vertical surface of said window, said vertical support means including at least a lower portion of said outer surface of said vertical member;

retention ear means for insertion into said at least one vertical groove of said grooved vertical frame members for retaining said suspension member in said at least one vertical groove;

said retention ear means being in form of at least one tab-like ear rigidly and immovably joined to said upper end of said vertical member, said at least one tab-like ear projecting sideways from a side of said vertical member, said at least one tab-like ear including an inner vertical face and a lower edge, said inner vertical face being disposed substantially in the same vertical plane as the plane of said outer surface of said vertical member;

said inside surface of said horizontal member being adapted to support an end of a shelf between said vertical member and said diagonal member;

fastening means for fastening said end of said shelf to said horizontal member;

whereby said pair of shelf suspension members, while fastened to said shelf, is mountable to and dismountable from said window by being tilted vertically and horizontally to effect therewith engagement and disengagement of said retention ear means from said at least one vertical groove of said grooved vertical frame members without unfastening said end of said shelf from said shelf suspension member.

10. The pair of shelf suspension members according to claim 9, including horizontal support means in form of at least a portion of said outside surface of said horizontal member, said horizontal support means being operative to support said suspension member on a horizontal portion of said window.

11. The pair of shelf suspension members according to claim 9, including horizontal support means in form of at least a portion of said lower edge of said at least one tab-like ear, said horizontal support means being operative to support said suspension member on a horizontal portion of said window.

12. The pair of shelf suspension members according to claim 9, including a horizontally-extending seat tab member having an inner end attached to and projecting orthogonally from said outer surface of said vertical member, said horizontally-extending seat tab member having a free outer end and a horizontal bottom face, the pair of shelf suspension members including horizontal support means in form of at least a portion of said horizontal bottom face for supporting said suspension member on a horizontal portion of said window, said horizontal support means being operative as a weight-supporting means for vertically supporting said shelf suspension member while said horizontal bottom face is born upon a horizontal surface of said window.

13. The pair of shelf suspension members of claim 12, wherein said horizontally-extending seat tab member is a tab-like ear of the break-away type.

* * * * *